US005228207A

United States Patent [19]

Michel et al.

[11] Patent Number: 5,228,207

[45] Date of Patent: Jul. 20, 1993

[54] GRAIN DRYING AND CONDITIONING APPARATUS

[75] Inventors: Eric D. Michel, Overton; Richard E. Lowe; Merle E. Lantzer, both of Kearney, all of Nebr.

[73] Assignee: Delux Mfg. Co., Kearney, Nebr.

[21] Appl. No.: 987,168

[22] Filed: Dec. 7, 1992

[51] Int. Cl.[5] ..... F26B 7/00

[52] U.S. Cl. ..... 34/12; 34/174

[58] Field of Search ..... 34/165, 167, 168, 169, 34/174, 175

[56] References Cited

U.S. PATENT DOCUMENTS

| | | | |
|---|---|---|---|
| 2,526,994 | 10/1950 | Cariani | 34/167 |
| 3,474,903 | 10/1969 | Ausherman | 209/11 |
| 3,659,351 | 5/1972 | Alms et al. | 34/174 |
| 3,739,493 | 6/1973 | Nivon | 34/164 |
| 3,896,562 | 7/1975 | Zimmerman | 34/174 |
| 4,149,844 | 4/1979 | Noyes | 432/17 |
| 4,242,806 | 1/1981 | McClaren | 34/13 |
| 4,249,891 | 2/1981 | Noyes et al. | 432/14 |
| 4,250,632 | 2/1981 | Botkins et al. | 34/169 |
| 4,263,722 | 4/1981 | Botkins et al. | 34/47 |
| 4,289,481 | 9/1981 | Yano | 432/96 |
| 4,308,669 | 1/1982 | Noyes et al. | 34/168 X |
| 4,914,834 | 4/1990 | Sime | 34/174 X |

*Primary Examiner*—Henry A. Bennet
*Attorney, Agent, or Firm*—Kinney & Lange

[57] ABSTRACT

A grain column dryer and conditioner includes two-spaced air pervious walls that form a generally vertical column of grain to be heated and dried. A plenum chamber is formed between the innermost of the pervious walls and is divided into upper and lower air flow sections by a plenum divider mounted within the innermost of the walls. A blower and burner assembly having an inlet and outlet is mounted within the plenum chamber to force heated air into the upper heated section and out through the column of grain adjacent the upper section while simultaneously pulling cooler air into the lower section of the plenum chamber through the grain column adjacent the lower section. A passageway for foreign particulate matter to travel from the upper section of the plenum chamber into a portion of the grain column adjacent the lower section of the plenum chamber prevents the accumulation of foreign particulate matter in the upper section of the plenum chamber, while maintaining sufficient pressure in the upper section to force heated air through the grain column adjacent the upper section.

11 Claims, 5 Drawing Sheets

GRAIN DRYING AND CONDITIONING APPARATUS

BACKGROUND OF THE INVENTION

This invention relates to a grain drying and conditioning apparatus of the type which includes a pair of spaced air previous walls confining a generally vertical column of grain, the innermost of the walls defining a plenum chamber, and the plenum chamber being divided into upper and lower air flow sections by a plenum divider. More particularly, this invention is directed to an improved grain drying and conditioning apparatus which includes a passageway for foreign particulate matter to travel from the upper section of the plenum chamber into a portion of the grain column adjacent the lower section of the plenum chamber.

Grain drying and conditioning apparatus are generally used to dry large quantities of grain. Such apparatus are often designed to operate in a continuous manner. Grain is fed into a top portion of the grain dryer and gradually flows down the grain column until it is removed by a suitable conveyor system adjacent a bottom of the grain dryer. Treated (heated) air is passed through the grain column so that the grain is heated and dried while it passes through a portion of the grain column adjacent the upper section of the plenum chamber and is cooled while it passes through a portion of the grain column adjacent the lower section of the plenum chamber.

During this process, foreign particulate matter from the grain, such as bee wings, fines cracks, shells and dirt collects on surfaces in the upper section of the plenum chamber. The collection of these materials reduces the efficiency of the grain dryer and presents a fire hazard. Accordingly, the upper section of the plenum chamber must be cleaned periodically to maintain the efficiency of the grain dryer and to prevent the occurrence of a fire.

In order to clean the upper section of the plenum chamber the operator must first shut down the grain dryer. The operator must then wait until the upper section has cooled to a temperature sufficient to permit a person to enter the plenum chamber. The operator then enters the chamber to sweep and collect the debris from the plenum chamber. After the upper section has been cleaned, the drier must be turned on and heated to a sufficient temperature to continue drying the grain.

The cleaning process of the plenum chamber divider is inefficient and expensive. The grain dryer must be shut down for periods of up to three hours. In addition, a large amount of thermal energy is wasted simply because the plenum chamber must be cooled down and then heated up again for every cleaning event. These expenses are usually quite large because a grain dryer operating under normal conditions requires cleaning at least once a day to maintain efficient operating parameters and to avoid becoming a fire hazard.

The cleaning process also exposes the operator to a variety of dangerous conditions. The upper section is very large and often relatively dark. Therefore, the operator must use a scaffolding and lighting system to reach most of the surfaces that require cleaning. The operator is also exposed to a large amount of foreign matter in the air during the sweeping and cleaning process. Therefore, the operator must wear protective clothing (including a breathing mask) to prevent the inhalation of the foreign matter (all within a relatively warm, enclosed space).

The primary purpose of such apparatus is to remove moisture from the grain and thus prevent mildew and spoilage. The apparatus is not necessarily designed to remove foreign matter from the grain and, in fact, that is an undesirable side effect of conditioning the grain. Grain transactions are typically conducted on a weight basis, so it is preferred that any foreign matter which is initially in the grain stay within the grain, at least through the drying and conditioning process. According, it would be advantageous to provide a means for removing foreign particulate matter which collects in the upper section of the plenum chamber and placing the foreign particulate matter back into the grain column without disrupting the continuous operation of the grain drier.

The handling of foreign matter in a grain dryer has been addressed by the prior art. For example, Zimmermann, U.S. Pat. No. 3,896,562, shows a grain conditioning apparatus which includes two concentric annular previous walls spaced to confine a grain column, and to form a plenum chamber. A blower and heater assembly is mounted within the plenum chamber. A baffle means is provided to separate the plenum chamber into positive and negative pressure zones. An annular slot permits solid material in the positive pressure zone to pass from the positive pressure zone to the negative pressure zone. The solid material is then drawn into the intake of the blower and heater assembly where it is purportedly consumed. If the foreign material is not completely consumed on the first pass, it is intended that it continue to pass through the burner until it is consumed and turned to fine ash. Thus, the solid material is not returned to the grain column, thereby reducing the total weight of the grain exiting the grain dryer.

Ausherman, U.S. Pat. No. 3,474,903, discloses a grain drying apparatus which includes a pair of conduits extending transversely of the dryer and through the side walls to convey combustible debris therefrom. Heated combustion gases act to discharge the inflammable debris and the like from the plenum chamber. Thus, the conduits discharge the debris into the atmosphere and do not return any of that material back into the grain column.

Sime, U.S. Pat. No. 4,914,834, shows an apparatus that reintroduces into a grain column fines and other debris collected outside an outermost pervious wall of the grain column. However, Sime does not show or teach a method or means to remove fines or other debris that can collect within the plenum chamber.

SUMMARY OF THE INVENTION

The present invention is an improved grain drying and conditioning apparatus of the type which includes a pair of spaced air pervious walls for confining a generally vertical column of grain to be heated and dried. An innermost pervious wall forms a plenum chamber. The plenum chamber is divided into upper and lower air flow sections by a plenum divider mounted within the innermost of the walls.

Blower and burner means having an inlet and outlet are mounted within the plenum chamber and spaced inwardly from the innermost wall for forcing heated air in the upper section of the plenum chamber through the column of grain adjacent the upper section, while simultaneously pulling cooler air into the lower section of the plenum chamber through the grain column adjacent the lower section of the plenum chamber.

The improvement includes bypass means for removing foreign particulate matter from the upper section of the plenum chamber while maintaining sufficient pressure in the upper section of the plenum chamber to force heated air through the grain column adjacent to the upper chamber. The bypass means has a passageway for foreign particulate matter to travel from the upper section of the plenum chamber into a portion of the grain column adjacent the lower section of the plenum chamber.

In one preferred embodiment, the improved grain drying and conditioning apparatus includes a passageway that has an orifice on the plenum divider extending into a hopper. A channel connects to the hopper and extends into the grain column at a point adjacent the lower portion of the plenum chamber.

In one embodiment, the orifice extends adjacent an outer edge of the plenum divider. The plenum divider has a V-shaped groove formed to extend toward the orifice. The hopper extends adjacent the outer edge of the plenum divider to receive the foreign particulate matter that flows through the V-shaped groove and the orifice. The hopper is designed so that its opposing walls converge as the hopper extends vertically downward to the channel.

In another preferred embodiment, the orifice has a slot having a first width extending into the hopper. The hopper has a second width larger than the first width.

In another embodiment, a door for inspecting and removing obstructions from the channel is mounted adjacent to the point at which the channel enters the grain column.

While the above-identified drawing features set forth one preferred embodiment, other embodiments of the present invention are also contemplated, as noted in the discussion. This disclosure presents an illustrative embodiment of the present invention by way of representation and not limitation. It should be understood that numerous other modifications and embodiments can be devised by those skilled in the art which fall within the scope and spirit of the principles of this invention.

DETAILED DESCRIPTION OF THE PREFERRED EMBODIMENTS

Figure 1:
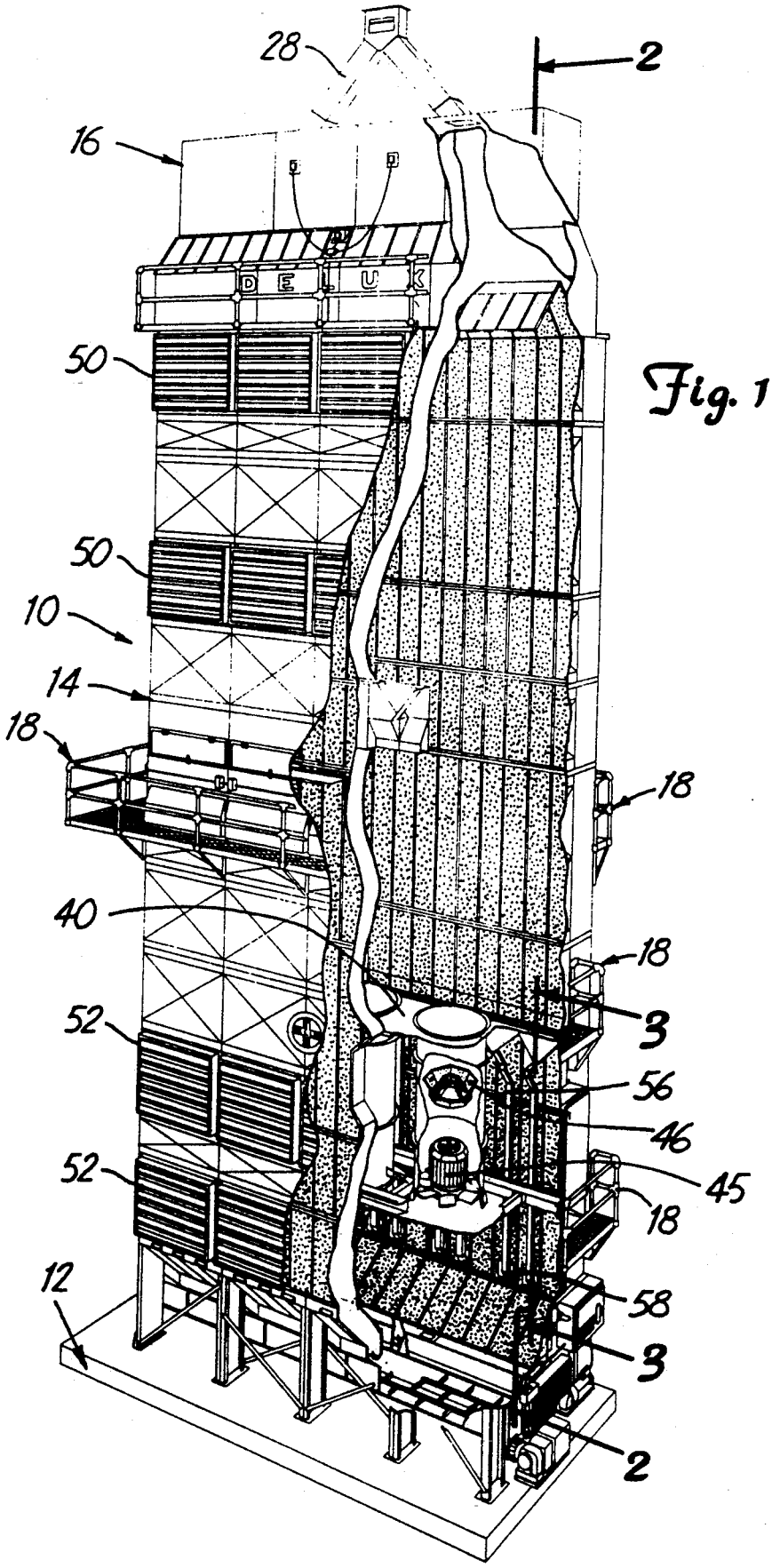
FIG. 1 is a perspective view of an improved grain dryer that incorporated the present invention, with a portion of the grain dryer cut away.

FIG. 1 shows a grain dryer 10 defined generally by a base 12, an outer skin 14 and a top portion 16. Service platforms 18 are attached to the outer skin 14 to provide access to various portions of the grain dryer 10.

Figure 2:
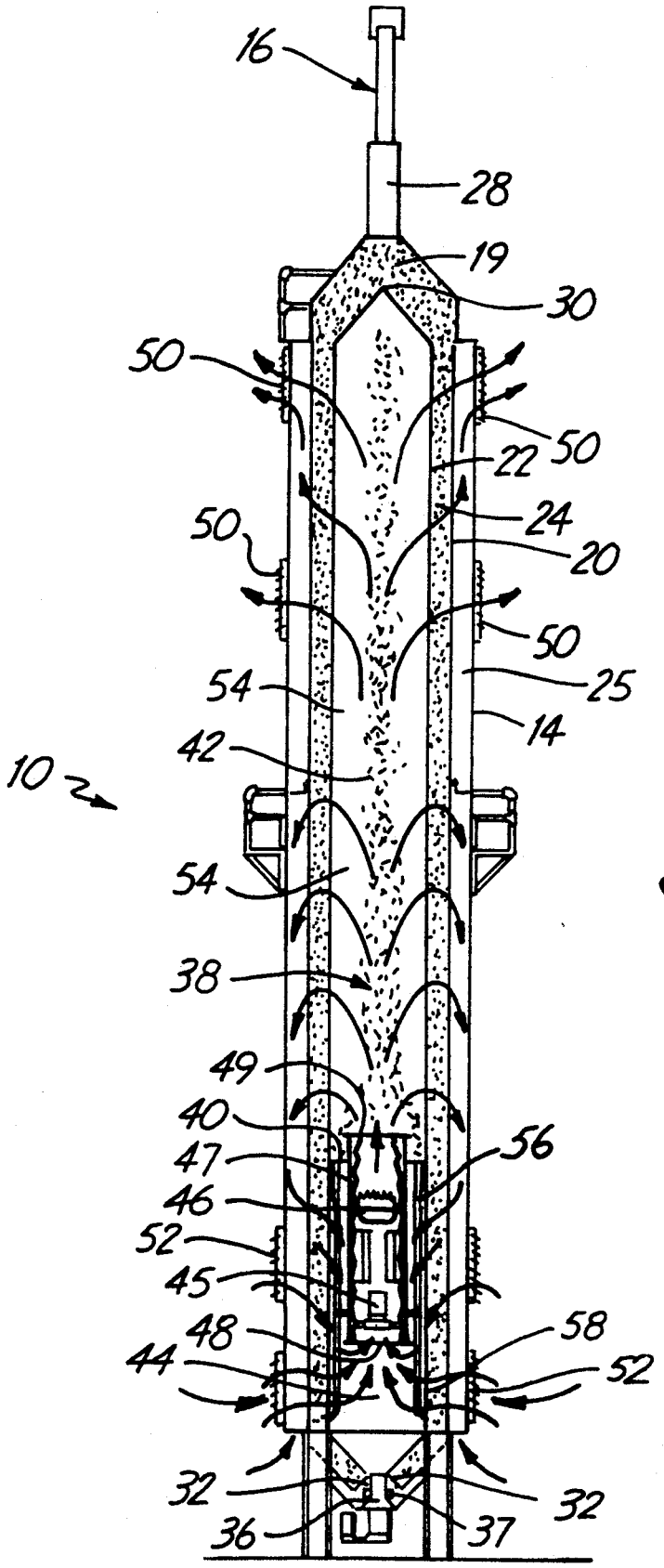
FIG. 2 is a sectional view as taken generally along Lines 2—2 of FIG. 1.

As seen more clearly in FIG. 2, an outer air pervious wall 20 and an inner air pervious wall 22 form a grain column 24. A recycling channel 25 is formed between the outer pervious wall 20 and the outer skin 14 (which is air impervious). The air pervious walls 20 and 22 are disposed on each side of the grain dryer 10. Inner air pervious walls 22 converge at a point 30 adjacent the top of the grain dryer 10. Grain 19 is fed into the top portion 16 and moves into grain column(s) 24 as illustrated in FIG. 2. The grain 19 is introduced into the top portion 16 with a feeder 28 in a conventional manner. At the bottom of the grain column 24, the grain 19 is guided into a conveyor system 36 located below grain outlets 32 to provide a means for removing the grain from the grain dryer 10. A metering device 37 is attached to the conveyor system 36 to control the rate of withdrawal of the grain.

The innermost pervious walls 22 define a plenum chamber 38. A plenum chamber divider 40 defines an upper chamber 42 and a lower chamber 44 within the plenum chamber 38. A blower 45 and a burner 46 are mounted within a housing 47. The housing 47 has an inlet 48 and an outlet 49 and is mounted between the upper chamber 42 and the lower chamber 44 within the plenum chamber 38 (see FIG. 1).

The air flow created by the blower 45 during the drying operating is generally shown by the arrows in FIG. 2. In particular, the blower 45 and the burner 46 force treated (heated) air through a portion of the grain column 24 adjacent the upper chamber 42. After the treated air passes through the grain column 24 it may be recirculated through the recycling channel 25 or it may be exhausted through exhaust louvers 50. The exhaust louvers 50 are opened when the grain is highly saturated and are closed when the grain is relatively dry, thereby recycling warm unsaturated air back to the blower 45. The blower 45 simultaneously draws the recirculated air through the grain column 24 adjacent the lower chamber. Intake louvers 52 permit the blower 48 to also draw fresh air through the lower portion of the grain column 24.

During the grain drying process, a variety of debris and foreign particulate matter 54 is agitated from the grain 19 as it flows through the grain column 24. The foreign matter 54 collects within the upper chamber 42 on the inner pervious wall 22 and the plenum chamber divider 40. The foreign matter 54 that collects on these surfaces within the upper chamber 42 reduces the efficiency of the grain dryer and presents a fire hazard. Accordingly, the previous grain dryers, the surfaces within the upper chamber 42 must be cleaned periodically to maintain the efficiency of the grain dryer and to avoid a fire hazard.

In addition, previous grain dryers present another undesirable side effect. Grain transactions are typically conducted on a weight basis, so it is preferred that any foreign matter 54 which is initially in the grain 19 stay within the grain, at lest through the drying and conditioning process. However, as the grain transverses a grain dryer, the foreign matter 54 typically becomes separated from the grain 19 and presents its own handling difficulties, as notes above. Ideally, the grain leaves the grain dryer containing the same amount (i.e., weight) of extraneous material that was present in the grain when it entered the grain dryer.

All of the various elements of the structures described above have been utilized in grain dryers previously. The following is a description of the improvements of the present invention over the apparatus and methods of the prior art.

As discussed above, previous grain dryers are deficient in two basic ways. First, the surfaces within the upper chamber 42 must be cleaned periodically to maintain the efficiency of the grain dryer and avoid a fire hazard. Secondly, the process removes foreign matter 54 from the grain 19, thereby reducing the total weight of the grain 19. The purpose of the present invention is to eliminate these basic deficiencies by providing a means for removing the foreign matter 54 from the upper chamber 42 and placing the grain 19 into a portion of the grain column 24. Therefore, as seen generally in FIGS. 1 and 2, a passageway 56 is provided within the plenum chamber 38. The passageway 56 is designed to permit the foreign particulate matter 54 to travel from the upper chamber 42 into a portion of the grain column 24 at re-entry point 58, while maintaining sufficient pressure in the upper chamber 42 to force the treated air through the grain column 24.

Figure 3:
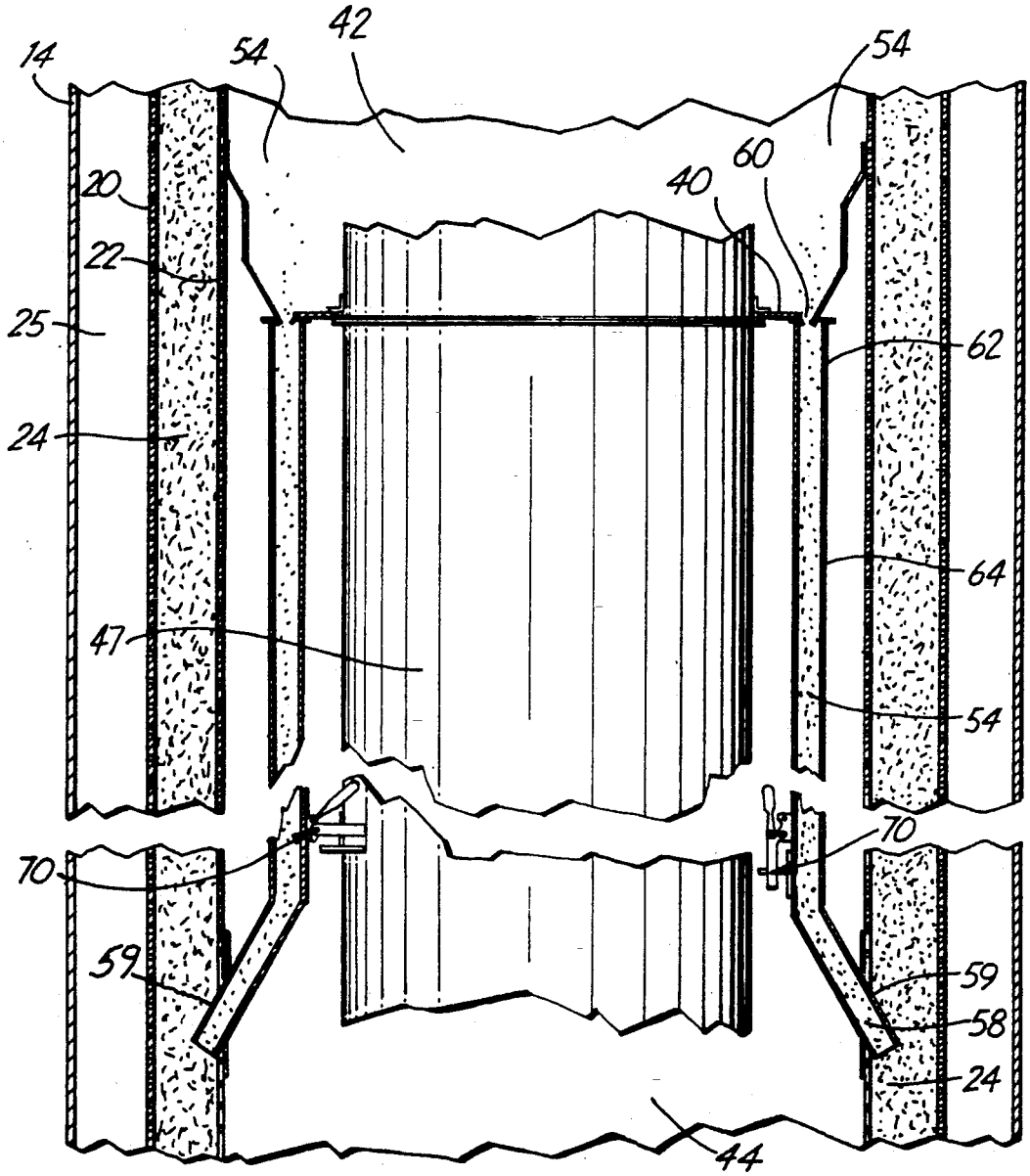
FIG. 3 is an enlarged sectional view as taken generally along Lines 3—3 of FIG. 1, showing the foreign matter bypass of the present invention.
Figure 4:
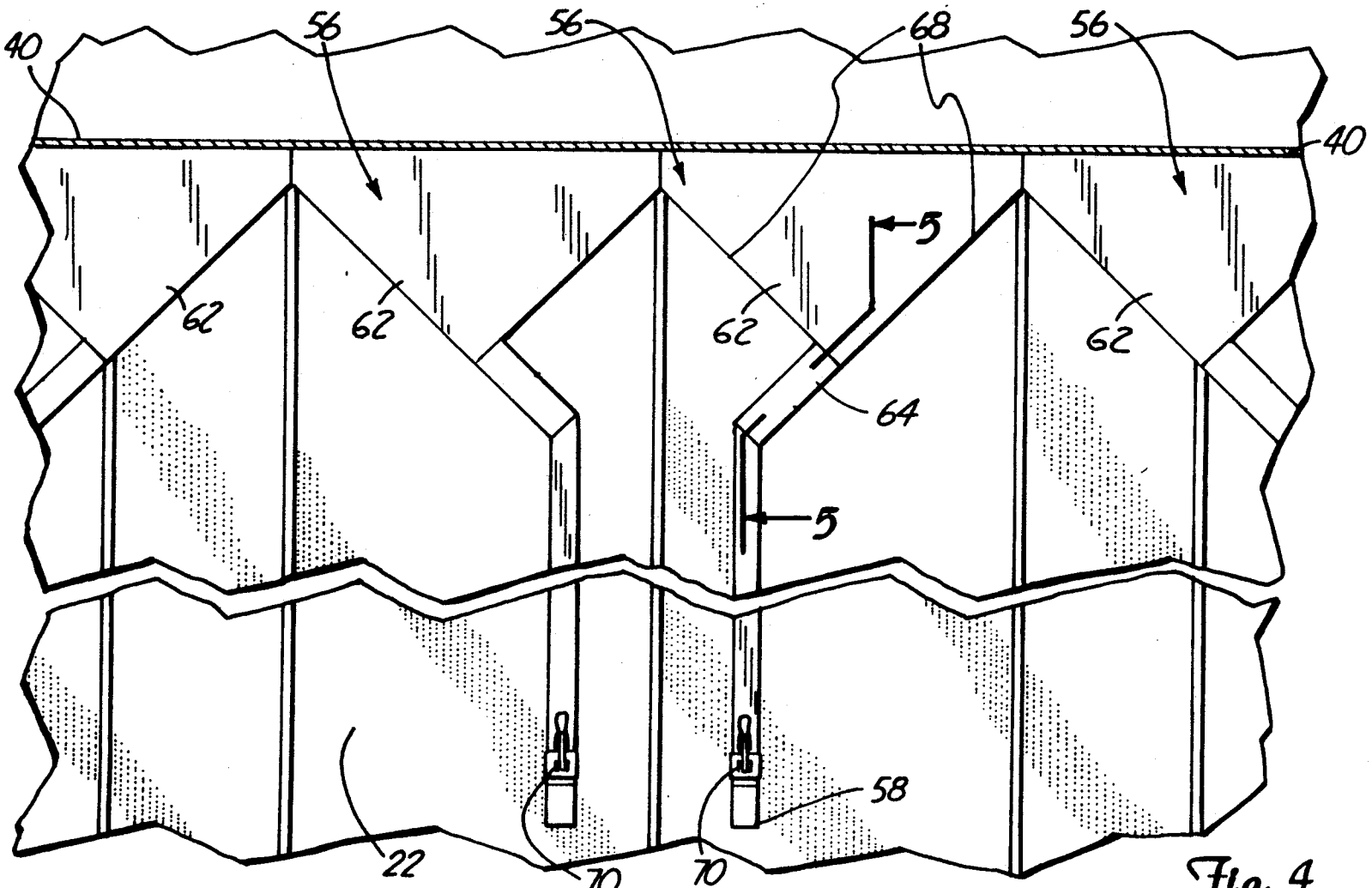
FIG. 4 is a side elevational view of the foreign matter bypass of the present invention.
Figure 5:
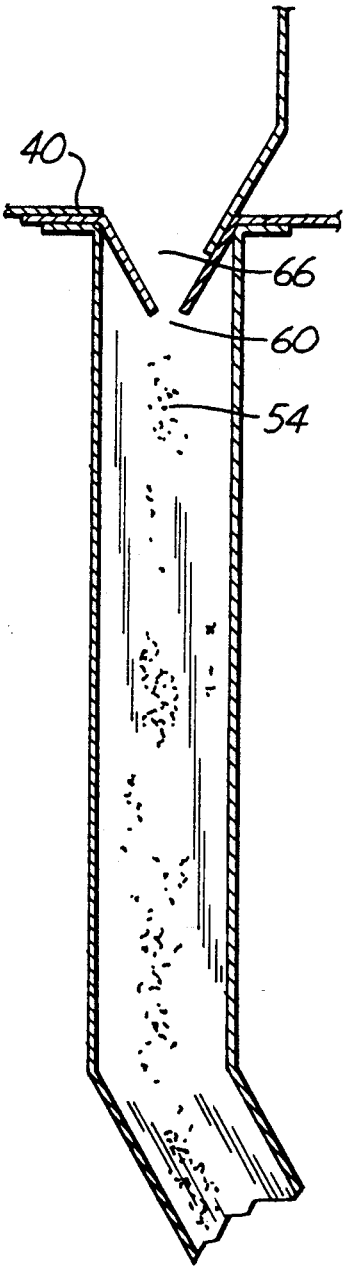
FIG. 5 is an enlarged sectional view as taken generally along Lines 5—5 of FIG. 4.

FIGS. 3, 4 and 5 more clearly show the foreign matter bypass of the present invention. The passageway 56 has an orifice 60 on the plenum chamber divider 40. The orifice 60 is an elongated V-shaped groove 66 extending on an outer edge of the plenum chamber divider 40 and adjacent the inner wall 22. The orifice 60 is designed to maintain sufficient pressure in the upper chamber 42 to force the treated air through the grain column 24 while providing an adequate path for the foreign matter 54. Accordingly, FIG. 5 shows one preferred embodiment of the V-shaped groove 66. The V-shaped groove 66 has an opening width of approximately 2 inches, with opposing walls that converge at 45° angles to an exiting width of approximately 0.25 inches. The above dimensions have been found to provide an adequate path for the foreign matter 54 while maintaining sufficient pressure in the upper chamber 52 for effective grain dryer operation.

The orifice 60 extends into and is enclosed by a hopper 62. The hopper 62 has opposing walls 68 that converge as the hopper extends vertically downward to a channel 64. The channel 64 is connected to the hopper 62 and extends vertically downward to a re-entry point 58. As seen more clearly in FIG. 3, the channel 64 extends into the grain column 24 at re-entry point 58, thereby providing a venturi-like flange 59 that permits the debris and foreign particulate matter 54 to re-enter the grain column 24. The re-entry point 58 is preferably disposed near the bottom of the grain column 24. Such a position has been found to reduce the amount of foreign matter 54 that is blown back into the lower chamber 44 by the air flow of the grain dryer.

As shown in FIG. 4, there is preferably a plurality of passageways 56. In this particular embodiment the hopper 62 has an initial width of 24 inches at the plenum chamber divider 40 and a depth of 2 inches. The opposing walls 68 of the hopper converge at 45° angles to the channel 64 which has a width of 2 inches and a depth of 2 inches. The above dimensions are selected such that gravitational forces are sufficient to force the foreign matter 54 through the hoppers 62 and the channels 64 to the re-entry points 58. These dimensions are also selected so that the foreign matter 54 will not collect within the passageway 56.

Figure 6:
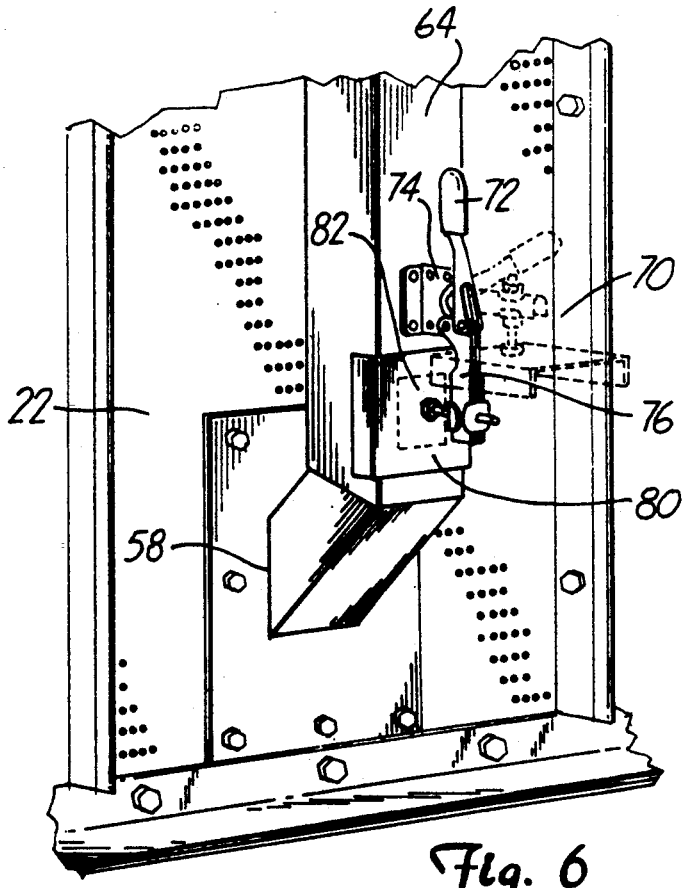
FIG. 6 is an enlarged perspective view of a lower portion of the foreign matter bypass of the present invention.

As seen generally in FIG. 6, an inspection means 70 is provided near the bottom of the channel 64 so that the operator can periodically inspect the channel 64 to ensure that the passageway 56 is functioning properly. In particular, FIG. 6 shows an over-center latch system 70 attached to the channel 64 at a point adjacent the re-entry point 58. The latch system 70 has a handle 72 attached to a mounting bracket 74 and a lifting arm 76. The lifting arm 76 is, in turn, connected to a door 80. The channel 64 has an opening 82 (shown in dashed lines) that is enclosed by the door 80 when the latch system is in the closed position. The latch system is shown in its normal closed position in FIG. 6. The latch system 70 is also shown in phantom in its open position, whereby it provides a means for inspecting the channel 64 through the opening 82 near the re-entry point 58. FIG. 3 also shows the latch system in its open and closed positions.

The following summarizes how the present invention provides an improved grain drying and conditioning apparatus. It should be noted again that the primary purpose of the grain dryer 10 is to remove moisture and not foreign particulate matter 54 from the grain 19. Accordingly, it is beneficial to keep the foreign particulate matter 54 in the grain 19. As seen in FIG. 2, grain 19 containing foreign particulate matter 54 is fed into the top portion 16 and moves into the grain column(s) 24 with a feeder 28. The grain 19 is naturally agitated by the surfaces of the inner pervious wall 22 and the outer pervious wall 20 as it enters and passes through the grain column(s) 24. This agitation tends to separate a variety of foreign particulate matter 54, such as bee wings, fines, cracks, shells and dirt from the grain 19. After being separated from the grain, the foreign material 54 can enter the upper chamber 42 through a number of passageways. The foreign material 54 can fall directly into the upper chamber 42 through the inner pervious wall 22 as it passes through the grain column 24. In addition, the foreign material 54 may be forced through the inner pervious wall 22 into the lower chamber 44 by the air flow produced by the blower 45. The blower 45 subsequently directs the foreign material 54 into the upper chamber 42. In previous grain dryers, the foreign matter 54 would collect within the upper chamber 42, thereby reducing the efficiency of the drying operation and presenting a fire hazard. The present invention provides the passageway 56 to remove the foreign matter 54 from the upper chamber 42 and place it back into the grain 19.

The passageway functions as follows. A pressure differential or pressure drop forms across the orifice 60 when the blower 45 is operating. Gravitational forces combine with the pressure differential across the orifice 60 to force the foreign matter 54 out of the upper chamber 42 and through the orifice 60. Gravity and pressure then further force the foreign matter down through the hopper 62 and into the channel 64. The foreign matter 54 continues to flow down the channel 64 to a re-entry point 58. The channel 64 extends into the grain column 24 to provide the venturi-like flange 59 so that the foreign matter 54 may re-enter the grain column 24. The venturi-like flange 59 also prevents the grain 19 from backing up or urging into the channel 64. The re-entry point 58 is disposed near the bottom of the grain column 24 to reduce the amount of foreign matter 54 that is blown back into the lower chamber 44 by the air flow of the grain dryer.

A grain dryer that incorporates the passageway 56 is essentially self-cleaning. Therefore, the passageway 56 eliminates the daily cleaning procedure required for previous grain dryers. The passageway 56 also greatly reduces the amount of foreign matter 54 that is removed from the grain 19 as it traverses the grain dryer, thereby maintaining the initial weight of the grain 19.

Although the present invention has been described with reference to preferred embodiments, workers skilled in the art will recognize that changes may be made in form and detail without deparating from the spirit and scope of the invention. In particular, a worker skilled in the art will recognize that the present invention may be adopted to any generally vertical grain dryer, including, but not limited to, a grain dryer that has a general cylindrical shape.

What is claimed is:

1. An improved grain drying and conditioning apparatus of the type which includes;

a pair of spaced air pervious walls for confining a generally vertical column of grain to be heated and dried, a plenum chamber formed between an innermost of the pervious walls, a plenum divider mounted within the innermost of the walls for dividing the plenum chamber into upper and lower air flow sections, and blower and burner means having an inlet and outlet, and mounted within the plenum chamber and spaced inwardly from the innermost wall, for forcing heated air in the upper section of the plenum chamber through the column of grain adjacent the upper section and simultaneously for pulling cooler air into the lower section of the plenum chamber through the grain column adjacent the lower section of the plenum chamber;

wherein the improvement comprises:

bypass means for removing foreign particulate matter from the upper section of the plenum chamber while maintaining sufficient pressure in the upper section of the plenum chamber to force heated air through the grain column adjacent to the upper chamber, with the bypass means including a passageway for foreign particulate matter to travel from the upper section of the plenum chamber into a portion of the grain column adjacent the lower section of the plenum chamber.

2. The grain drying and conditioning apparatus of claim 1 wherein the passageway comprises:

an orifice on the plenum divider extending into a hopper, a channel connected to the hopper, the channel extending into the grain column at a point adjacent the lower section of the plenum chamber.

3. The grain drying and conditioning apparatus of claim 2 wherein the orifice extends adjacent an outer edge of the plenum divider.

4. The grain drying and conditioning apparatus of claim 3 wherein the plenum divider has a V-shaped groove formed to extend toward the orifice.

5. The grain drying and conditioning apparatus of claim 4 wherein the hopper extends adjacent the outer edge of the plenum divider.

6. The grain drying and conditioning apparatus of claim 5 wherein opposed walls of the hopper converge as the hopper extends vertically downward to the channel.

7. The grain drying and conditioning apparatus of claim 2 wherein the orifice has a slot having a first width extending into the hopper having a second width larger than the first width.

8. The grain drying and conditioning apparatus of claim 2 and further comprising:

door means for inspecting and removing obstructions from the channel mounted adjacent the point at which the channel enters the grain column.

9. The grain drying and conditioning apparatus of claim 1 wherein the passageway has a lower opening in the portion of the grain column adjacent the lower section of the plenum chamber, and wherein the lower opening is near the bottom of the grain column.

10. An improved method for drying and conditioning grain which includes:

providing a grain dryer having spaced air pervious walls for confining a generally vertical column of grain to be heated and dried, a plenum chamber between an innermost of the pervious walls, and a plenum divider within the innermost of the walls to divide the plenum chamber into upper and lower air flow sections;

forcing heated air into the upper section of the plenum chamber through the column of grain adjacent the upper section; and pulling cooler air into the lower section of the plenum chamber through the grain column adjacent the lower section of the plenum chamber;

wherein the improvement comprises:

removing foreign particulate matter from the upper section of the plenum chamber while maintaining sufficient pressure in the upper section of the plenum chamber to force heated air through the grain column adjacent to the upper chamber; and placing the foreign particulate matter into a portion of the grain column adjacent the lower section of the plenum chamber.

11. The improved method of drying and conditioning grain wherein the placing step further comprises:

introducing the foreign particulate matter into the grain column near the bottom of grain column.

* * * * *